US007459010B2

(12) United States Patent
Johansson

(10) Patent No.: US 7,459,010 B2
(45) Date of Patent: Dec. 2, 2008

(54) METHOD AND APPARATUS FOR THE ACCELERATION OF AN ELECTROMAGNETIC RAPPER

(75) Inventor: Anders Johansson, Hovmantorp (SE)

(73) Assignee: Alstom Technology Ltd, Baden (CH)

( * ) Notice: Subject to any disclaimer, the term of this patent is extended or adjusted under 35 U.S.C. 154(b) by 2 days.

(21) Appl. No.: 11/780,974

(22) Filed: Jul. 20, 2007

(65) Prior Publication Data

US 2008/0196579 A1 Aug. 21, 2008

Related U.S. Application Data

(63) Continuation of application No. PCT/EP2006/050794, filed on Feb. 9, 2006.

(30) Foreign Application Priority Data

Feb. 10, 2005 (EP) ..... 05100963

(51) Int. Cl.
*B03C 3/76* (2006.01)

(52) U.S. Cl. ..... 95/76; 96/32; 96/36; 96/37; 323/903

(58) Field of Classification Search ..... 96/32–38, 96/80; 95/74, 76, 81; 323/903
See application file for complete search history.

(56) References Cited

U.S. PATENT DOCUMENTS

| | | | | | |
|---|---|---|---|---|---|
| 2,854,089 | A | | 9/1958 | White et al. | |
| 2,858,900 | A | * | 11/1958 | Foley | 96/25 |
| 2,922,085 | A | * | 1/1960 | Drenning et al. | 96/25 |
| 3,360,902 | A | * | 1/1968 | Glaeser | 95/26 |
| 3,487,606 | A | * | 1/1970 | Bridges et al. | 95/26 |
| 3,504,480 | A | | 4/1970 | Copcutt et al. | |
| 4,255,775 | A | * | 3/1981 | Andrews | 96/25 |
| 4,285,024 | A | * | 8/1981 | Andrews | 96/25 |
| 4,305,736 | A | * | 12/1981 | Kahl et al. | 96/36 |
| 4,767,423 | A | | 8/1988 | Baylis | |
| 4,928,456 | A | * | 5/1990 | Del Gatto et al. | 95/74 |
| 5,015,267 | A | * | 5/1991 | Del Gatto et al. | 95/2 |
| 5,114,442 | A | * | 5/1992 | Artz | 96/19 |
| 5,173,867 | A | * | 12/1992 | Johnston et al. | 700/275 |
| 5,378,978 | A | * | 1/1995 | Gallo et al. | 323/241 |
| 5,792,240 | A | * | 8/1998 | Lund | 96/32 |
| 5,931,989 | A | * | 8/1999 | Knutsson | 96/33 |
| 6,540,812 | B2 | * | 4/2003 | Farmer et al. | 95/2 |
| 2003/0010203 | A1 | * | 1/2003 | Farmer et al. | 95/2 |

FOREIGN PATENT DOCUMENTS

| | | | | | |
|---|---|---|---|---|---|
| CA | 1129788 | A | | 8/1982 | |
| GB | 684066 | A | | 12/1952 | |
| GB | 2186508 | A | * | 8/1987 | 96/33 |

* cited by examiner

*Primary Examiner*—Richard L Chiesa
(74) *Attorney, Agent, or Firm*—Volpe and Koenig P.C.

(57) ABSTRACT

A method for the acceleration of an electromagnetic rapper, particularly for an electrostatic precipitator, which includes a metal cylinder as a hammer, an electrical coil for lifting the metal cylinder and a coil energizer for energizing the electrical coil. For cleaning a surface the metal cylinder is lifted by an initial electrical pulse generated by the coil energizer. The coil energizer supplies the electrical coil with an additional electrical pulse so that the metal cylinder is accelerated when it has reached the maximum point of its trajectory.

15 Claims, 3 Drawing Sheets

METHOD AND APPARATUS FOR THE ACCELERATION OF AN ELECTROMAGNETIC RAPPER

CROSS REFERENCE TO RELATED APPLICATION

This application is a continuation of International Application No. PCT/EP2006/050794 filed Feb. 9, 2006, which is incorporated by reference as if fully set forth.

FIELD OF INVENTION

The invention relates to a method for the acceleration of an electromagnetic rapper, particularly for an electrostatic precipitator and a corresponding apparatus.

BACKGROUND

Rappers are electromechanical devices which are used for mechanically and periodically cleaning dust from surfaces. During the operation of electrostatic precipitators, electronic filters or dust collectors, the collector plates, electrodes or other components must be cleaned by electromechanical rappers to remove the dust which has accumulated on these surfaces. In general, a rapper consists of a hammer that mechanically hits a surface to be cleaned or an anvil which is connected to the surface to be cleaned. The shock caused by the hitting hammer causes the dislodging of the dust.

U.S. Pat. No. 4,767,423 discloses a rapping mechanism which is used in electrostatic precipitators. In the disclosed mechanism, a spring or a drop hammer is provided behind a cylindrical hammer in order to increase the impact force of the hammer. The spring or the drop hammer may be mounted so that it can be swung from an inoperative position to an operative position in case an additional impact force is needed. In an operative position, the impact force is increased due to the added mass of the drop hammer or due to the elastic force of the spring.

Canadian patent No. 1129788 describes a rapping apparatus for an electrostatic precipitator. A free-fall hammer is attached to a rotating shaft so that it falls against an anvil from a top dead centre position. The size and the weight of this tumbling hammer is selected to obtain the desired maximum rapping intensity with a free fall. In order to vary or decrease the rapping intensity, an attenuator plate is located within the free-fall area of the hammer. By intercepting the hammer during its downfall and subsequently releasing it, the impact force is reduced to its desired amount. The attenuator plate is adjustable to modify the rapping intensity.

The correct balance of rapping intensity, duration and frequency is essential to an optimum precipitator performance. Inadequate cleaning of discharge electrodes and collecting plates is a dominating cause of poor precipitator performance, resulting in increased sparking, reduced power to the precipitator and higher emissions. The increasingly stringent controls on industrial emission lead to strengthened efforts to develop highly effective precipitators.

In both the U.S. Pat. No. 4,767,423 describing an electromagnetic rapper and the Canadian patent No. 1129788 describing a tumbling hammer the intensity of the impact force of the hammer can be varied by mechanical devices like a drop hammer or a spring to increase the impact force or an attenuator plate to decrease the impact force. However, the implementation of these mechanical devices can prove to be complex and expensive with regard to installation and maintenance.

SUMMARY

Therefore, it is an object of the present invention to provide a method and an apparatus for the acceleration of an electromagnetic rapper, particularly for an electrostatic precipitator, which comprises an increased cleaning capacity by the acceleration of the hammer which can be implemented in a technically less extensive and expensive way.

The invention relates to a method for the acceleration of an electromagnetic rapper, particularly for an electrostatic precipitator. The rapper including a metal cylinder as a hammer, an electrical coil for lifting the metal cylinder, and a coil energizer for energizing the electrical coil. To clean a surface, the metal cylinder is lifted by an initial electrical pulse generated by the coil energizer. The coil energizer supplies the electrical coil with an additional electrical pulse so that the metal cylinder is accelerated when it has reached the maximum point of its trajectory.

The invention also relates to an apparatus for the acceleration of an electromagnetic rapper, particularly for an electrostatic precipitator. The apparatus including a metal cylinder as a hammer, an electrical coil for lifting the metal cylinder, and a coil energizer for energizing the electrical coil. To clean a surface, the metal cylinder can be lifted by an initial electrical pulse generated by the coil energizer. The coil energizer is adapted to supply the electrical coil with an additional electrical pulse so that the metal cylinder is accelerated when it has reached the maximum point of its trajectory.

BRIEF DESCRIPTION OF THE DRAWINGS

The present invention will now be described, by way of example, with reference to the accompanying drawings, in which.

DETAILED DESCRIPTION OF THE PREFERRED EMBODIMENTS

Introduction to the Embodiments

Figure 1:
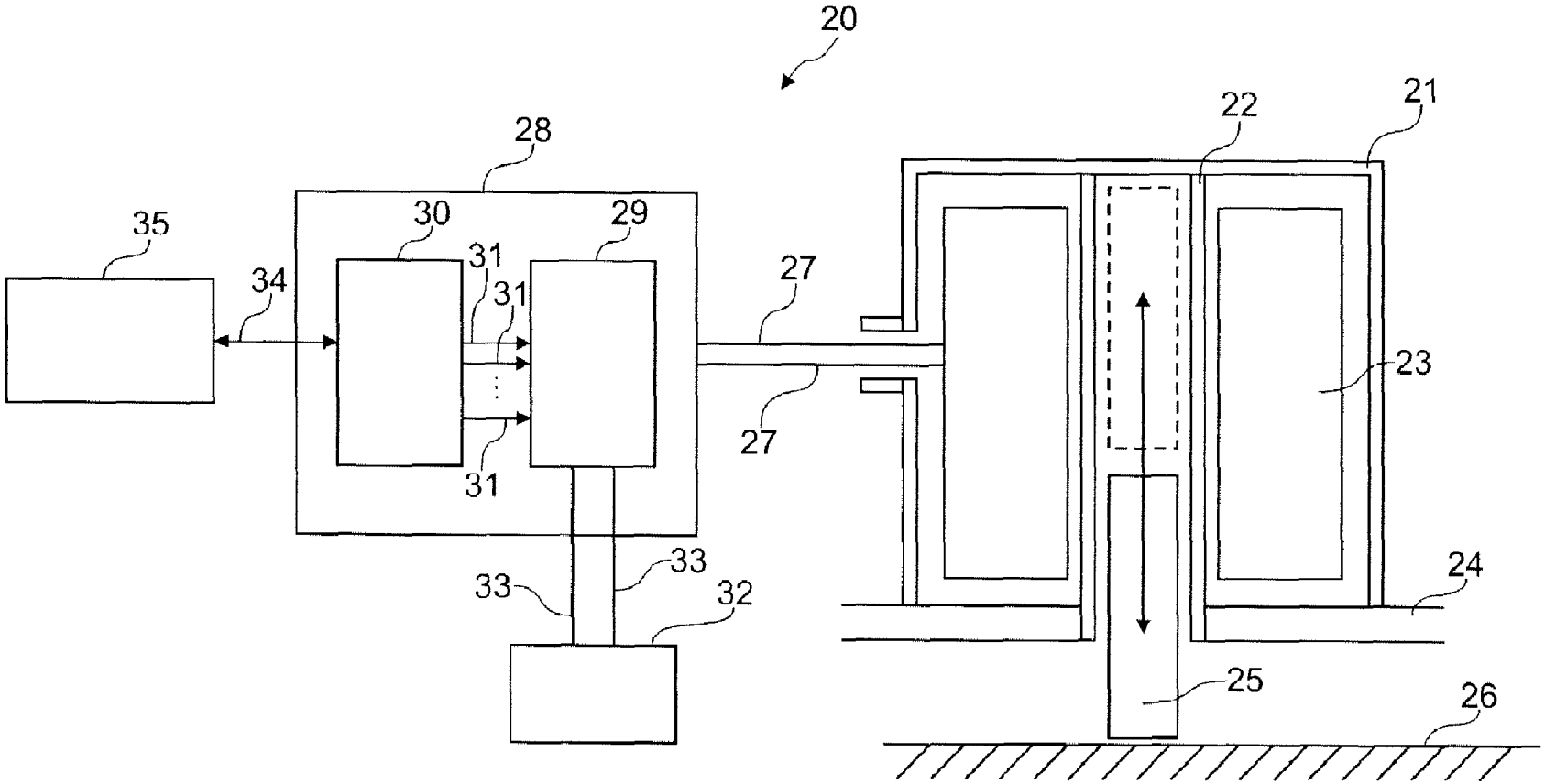
FIG. 1 shows an embodiment of an electromagnetic rapper with a coil energizer according to the invention.

According to a first aspect of the invention, the cleaning capacity of an electromagnetic rapper is increased by supplying the electrical coil with an additional electrical pulse for accelerating a metal cylinder as a hammer of the rapper when the metal cylinder has reached the maximum point of its trajectory. This additional electrical pulse causes an additional magnetic force which together with gravity leads to an increased acceleration, and thus to an increased impact force of the metal cylinder. One advantage of the invention is that existing coil energizers can be used for generating the additional electrical pulse for accelerating the metal cylinder.

The present invention relates to a method for the acceleration of an electromagnetic rapper, particularly for an electrostatic precipitator, which comprises a metal cylinder as a hammer, an electrical coil for lifting the metal cylinder and a coil energizer. For cleaning a surface the metal cylinder is lifted by an initial electrical pulse generated by the coil energizer. The coil energizer supplies the electrical coil with an additional electrical pulse so that the metal cylinder is accelerated when it has reached the maximum point of its trajectory. According to the additional electrical pulse supplied to the electrical coil, the velocity of the metal cylinder increases faster than without the additional electrical pulse. Furthermore, due to the additional electrical pulse, the maximum velocity of the metal cylinder can be higher than the maximum velocity without the additional electrical pulse. By means of the additional electrical pulse, the kinetic energy and thus the impact force of the metal cylinder is increased. Since the velocity of the metal cylinder is increased by the additional electric pulse, the duration until the metal cylinder hits the surface to be cleaned or an anvil connected to the surface to be cleaned is decreased. This leads to shorter rapping cycles during operation of the electromagnetic rapper.

Particularly an intensity of the additional electrical pulse is varied so that the metal cylinder is accelerated to an impact force which is desired for obtaining a predefined cleaning capacity. The intensity of the additional electrical pulse influences the additional acceleration of the metal cylinder and thus the additional magnetic force applied to it. By appropriately selecting the pulse intensity, a force can be applied to the surface to be cleaned which is adapted to an efficient cleaning capacity and an improved life of the machine parts involved in the cleaning process.

Further the duration of the additional electrical pulse can be varied so that the metal cylinder is accelerated to an impact force which is desired for obtaining a predefined cleaning capacity. Also, the duration of the additional electrical pulse influences the additional acceleration of the metal cylinder and thus the additional magnetic force applied to it.

It is possible that the intensity of the additional electrical pulse is varied depending on the duration and the intensity of the initial electrical pulse, particularly in order to achieve a highly efficient cleaning process.

Also, it is possible that the duration of the additional electrical pulse is varied depending on the duration and the intensity of the initial electrical pulse.

Therefore, by adjusting the intensity and the duration of the initial electrical pulse as well as the additional electrical pulse, the lifting height of the metal cylinder and the acceleration of the metal cylinder can be adapted to different requirements in a wide variety. Thus, the invention makes it possible either to increase the cleaning capacity of the metal cylinder or to build rappers which are smaller and have an impact force comparable to larger rappers.

In a further embodiment of the invention, the duration between supplying the initial electrical pulse and the additional electrical pulse is calculated depending on the duration and the intensity of the initial electrical pulse. With both the intensity and the duration of the initial electrical pulse the lifting height of the metal cylinder and the cylinder velocity or the time, in which the metal cylinder will reach the maximum height, can be adjusted. Furthermore, the optimal point in time for supplying the additional electrical pulse, preferably at the time when the metal cylinder reaches the maximum point of its trajectory, can be calculated depending on these values.

In addition the present invention relates to an apparatus for the acceleration of an electromagnetic rapper, particularly for an electrostatic precipitator, comprising a metal cylinder as a hammer, an electrical coil for lifting the metal cylinder and coil energizer. In order to clean a surface, the metal cylinder is lifted by an initial electrical pulse generated by the coil energizer. Said coil energizer is adapted to supply the electrical coil with an additional electrical pulse so that the metal cylinder is accelerated when it has reached the maximum point of its trajectory. Using existing coil energizers by supplying the initial electrical pulse, it is possible to supply the additional electrical pulse for an acceleration of the metal cylinder in a technically less extensive and expensive way.

In a preferred embodiment said coil energizer comprises a pulse generator for generating the initial electrical pulse and the additional electrical pulse and a rapper controller for controlling the pulse generator. Preferably the pulse generator can supply the electrical coil with an initial electrical pulse and an additional electrical pulse with the same polarity and evade a remagnetization of the metal cylinder which consumes power and therefore decreases the acceleration of the metal cylinder. In other embodiments it might be necessary to switch polarities. In this case the pulse generator can comprise a switch for switching the polarity of the supplied pulses in order to provide electrical pulses with different polarities. The rapper controller can further generate control signals and send them to the pulse generator to adjust intensity and duration of the initial electrical pulse and the additional electrical pulse depending on the desired cleaning capacity.

Particularly said rapper controller comprises a data input to adjust a duration and an intensity of the initial electrical pulse and the additional electrical pulse. An outside data input can be necessary in applications which comprise a plurality of rappers. In this case, a central computer can control an appropriate functioning and cooperation of the plurality of rappers and, therefore, can be connected to said data input. Said data input could also be connected with a user interface which enables an operator to manually control the rapper functions.

Preferably said rapper controller comprises an adjuster to vary the intensity and the duration of the initial electrical pulse. By adjusting the intensity and the duration of the initial electrical pulse in order to obtain an appropriate cleaning force to the surface to be cleaned, damages of this surface according to inappropriate forces can be prevented.

Furthermore, said rapper controller can comprise an adjuster to vary the intensity of the additional electrical pulse so that the metal cylinder is accelerated to a desired impact force for obtaining a predefined cleaning capacity.

Alternatively or additionally, said rapper controller can comprise an adjuster to vary the duration of the additional electrical pulse so that the metal cylinder is accelerated to a desired impact force for obtaining a predefined cleaning capacity.

The rapper controller can also comprise an adjuster to vary the intensity of the additional electrical pulse depending on the duration and the intensity of the initial electrical pulse.

The rapper controller can also comprise an adjuster to vary the duration of the additional electrical pulse depending on the duration and the intensity of the initial electrical pulse.

Typically, said rapper controller can comprise a calculator to calculate the duration between the initial electrical pulse and the additional electrical pulse.

The adjuster for varying the intensity of the initial electrical pulse, the adjuster for varying the duration of the initial electrical pulse, the adjuster for varying the intensity of the additional electrical pulse, the adjuster for varying the duration of the additional electrical pulse and the calculator for calculating the duration between the initial electrical pulse and the additional electrical pulse can generate control signals. These control signals cause the pulse generator to generate the initial electrical pulse and the additional electrical pulse with appropriate intensities and durations as necessary for the desired cleaning capacity of the rapper.

Additional objects, advantages, and features of the present invention will become apparent from the following description taken in conjunction with the accompanying drawings.

DETAILED DESCRIPTION

FIG. 1 shows an electromagnetic rapper 20 for cleaning surfaces of various equipment. The rapper 20 is in principal a large electrical coil 23 that, when energized, lifts a metal cylinder 25. Furthermore, the rapper comprises a housing 21 for the metal cylinder 25, a guide 22 for the metal cylinder 25, and mounting for the rapper 24 in a predefined distance to the surface to be cleaned 26 or the anvil connected to the surface to be cleaned. The electrical coil 23 is connected to a coil energizer 28 by a wire connection 27 for supplying the coil with electric energy. The electric energy is provided via electric pulses for moving the metal cylinder 25 inside the guide 22. When the electrical coil 23 is energized with electrical energy from the coil energizer 28, particularly when an electric current flows through the electrical coil 23, the metal cylinder 25 is moved due to the magnetic force caused by the electrical coil 23.

The coil energizer 28 comprises a pulse generator 29 and a rapper controller 30. A power source 32 for supplying the electrical coil with electric energy is connected with the pulse generator 29 by a wire connection 33.

The pulse generator 29 generates pulses from the electric energy supplied by the power source 32. In this embodiment the pulse generator is operated by DC current and the polarities of the initial electrical pulse and the additional electrical pulse are equal. In other embodiments it might be necessary to operate with AC current and to switch polarities of the initial electrical pulse 4 and the additional electrical pulse 7. In this case the pulse generator 29 can comprise a switch for switching the polarity of the generated pulses. Because of the changing of magnetization of the metal cylinder 25 a period of demagnetization occurs after each polarity shift. An integral of forces applied to the metal cylinder 25 will then be smaller than without the changing of magnetization of the metal cylinder 25.

The rapper controller 30 generates control signals 31 which are transmitted to the pulse generator 29 in order to adjust the intensity and the duration of the initial electrical pulse 4 and the additional electrical pulse 7 depending on the desired cleaning capacity.

A central computer 35 is provided for generating control signals for controlling the coil energizer 28, particularly the generation of electric pulses. A data connection 34 is provided between the rapper controller 30 and the central computer 35 over which the control signals are transmitted from the central computer 35 to the rapper controller 30. Especially in applications where a plurality of rappers is mounted, the central computer 35 controls the appropriate functioning and synchronization of this plurality of rappers.

Figure 2:
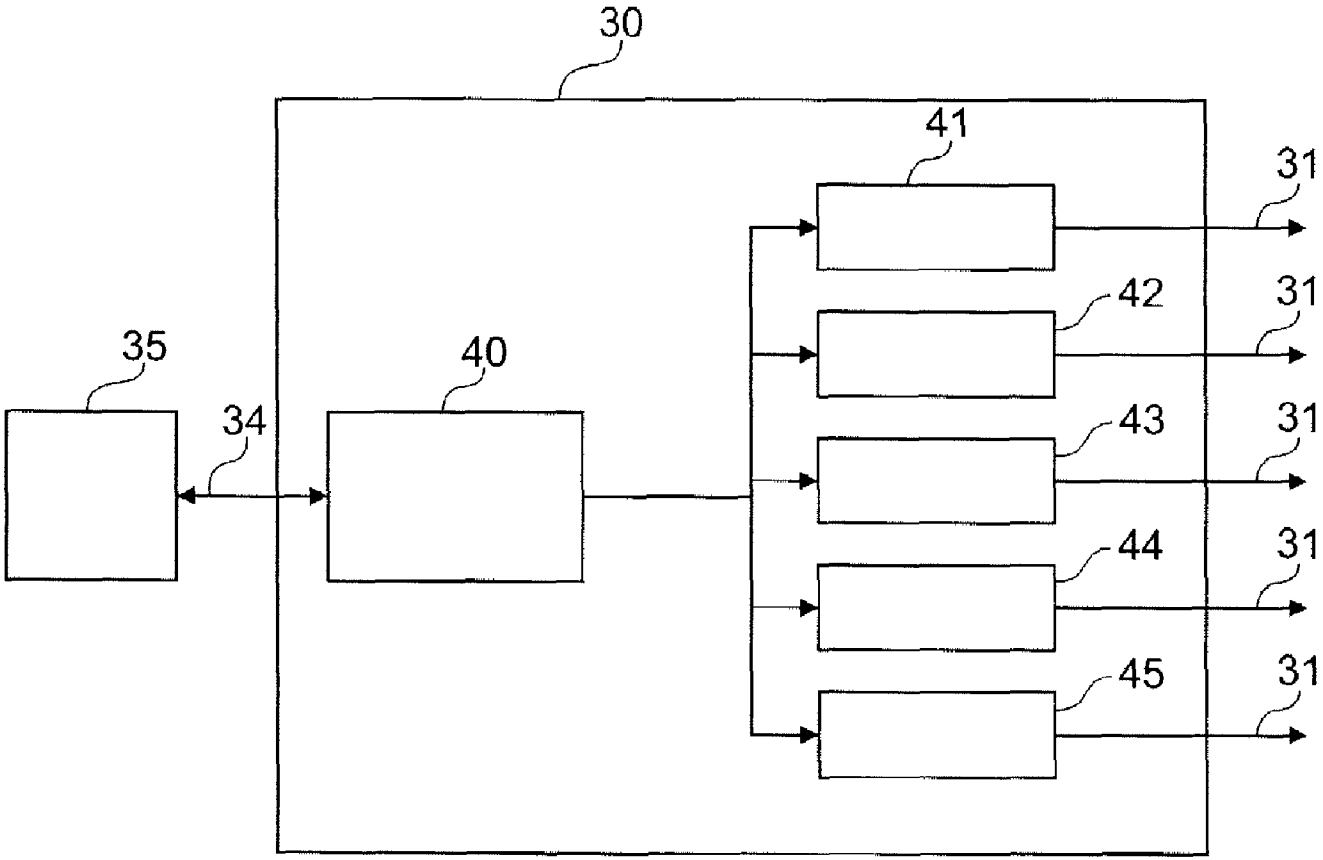
FIG. 2 shows a block diagram of the rapper controller of the electromagnetic rapper of FIG. 1.

FIG. 2 shows the rapper controller 30 in more detail. The controller 30 has a data input 40, an adjuster for varying the intensity of the initial electrical pulse 41, an adjuster for varying the duration of the initial electrical pulse 42, an adjuster for varying the intensity of the additional electrical pulse 43, an adjuster for varying the duration of the additional electrical pulse 44 and a calculator for calculating the duration between the initial electrical pulse and the additional electrical pulse 45.

The data input 40 process data from the central computer 35, i.e. controls the adjusters 41 to 45 depending on the received data input from the central computer 35.

The adjuster for varying the intensity of the initial electrical pulse 41, the adjuster for varying the duration of the initial electrical pulse 42, the adjuster for varying the intensity of the additional electrical pulse 43, the adjuster for varying the duration of the additional electrical pulse 44 and the calculator for calculating the time period between the initial electrical pulse and the additional electrical pulse 45 generate further control signals 31 which are processed from the pulse generator 29. Particularly, the control signals 31 prompt the pulse generator 29 to generate the initial electrical pulse 4 and the additional electrical pulse 7 with appropriate intensities and durations as required for the desired cleaning capacity of the rapper 20.

Figure 3:
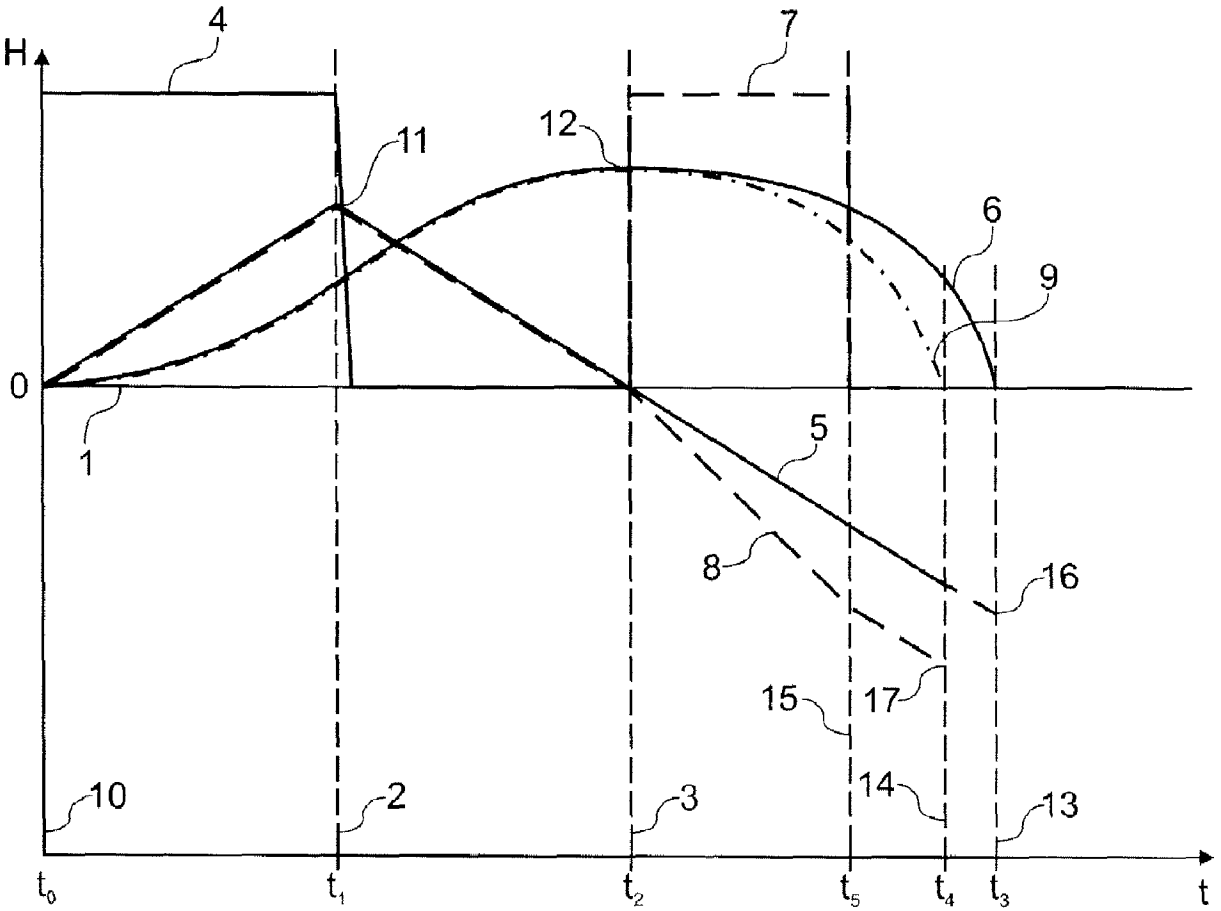
FIG. 3 shows in a timing diagram a rapping cycle of the metal cylinder of the electromagnetic rapper of FIG. 1.

FIG. 3 shows in a timing diagram the course of several parameters during a rapping cycle of the metal cylinder. At time t0 10 the metal cylinder 25 is in its starting position of a rapping cycle. The cylinder 25 is stopped, i.e. has a velocity of zero, and no force is applied at the surface to be cleaned 26. Then, the electrical coil 23 is supplied with an initial electrical pulse 4 which generates a magnetic force inside the guide 22 which lifts the metal cylinder 25 so that it moves away from the surface to be cleaned 26 (line 6). Line 5 depicts the rising velocity of the metal cylinder 25 when it is lifted and moves away from the surface to be cleaned 26. As the velocity 5 is rising linear, the height 6 of the metal cylinder 25 is increasing non-linear. At time $t_1$ 2 the initial electric pulse 4 is switched off. This results in a break down of the magnetic field inside the guide 22. At this time the metal cylinder 25 has reached its highest velocity 11 which is measured to lift the metal cylinder 25 to a height 6 at which the potential energy is sufficient to apply the desired force to the surface to be cleaned 26. Without an magnetic force inside the guide 22, the cylinder 25 is no longer accelerated. Thus, the velocity 5 of the metal cylinder 25 is lowered until zero at the maximum height of the metal cylinder 25 which is reached at the time $t_2$ 3 (reference numeral 12 in FIG. 3). At 12, the metal cylinder 25 has reached the maximum point of its trajectory.

At this time $t_2$ 3 the metal cylinder 25 begins to fall down from the height to the surface to be cleaned 26. As the metal cylinder 25 moves towards the surface to be cleaned 26, its velocity increases again (in FIG. 3 the velocity of the falling cylinder 25 is plotted in the timing diagram with a negative sign). With the increasing velocity 5 and the decreasing height 6, the metal cylinder 25 is gaining kinetic energy which causes the impact force when the cylinder 25 hits the surface 26. At the time $t_3$ 13 the metal cylinder 25 hits the surface to be cleaned 26 at a the velocity 16. The hitting force depends on the kinetic energy the falling cylinder 25 has obtained during its downfall towards the surface to be cleaned 26. After that a new rapping cycle may start.

According to the invention the impact force can be increased by an additional electrical pulse 7 supplied to the electrical coil 23 at the time $t_2$ 3 when the metal cylinder 25 has reached the maximum point of its trajectory. Based on the fact, that the electrical coil 23 is centered and the metal cylinder 25 has passed that centered position, the additional electrical pulse 7 applies an additive magnetic force which tries to move back the metal cylinder 25 in direction to the centre point of the electrical coil 23 and which together with gravity increases the acceleration of the metal cylinder 25 and thus the impact force to the surface to be cleaned 26. During the additional pulse 7, supplied to the electrical coil 23, the velocity of the metal cylinder 25 increases more than without the additional electrical pulse 7 (which is shown by dotted line 8 in FIG. 3 compared to line 5 which shows the velocity of the cylinder 25 without an additional electric pulse). At time $t_5$ 15, when the additional electrical pulse 7 is switched off, the velocity 8 increases further due to gravity but slower because the magnetic force caused by the additional electric pulse 7 is also switched off. At the time $t_4$ 14, the velocity reaches its maximum 17 when the metal cylinder 25 hits the surface to be cleaned 26. Due to the additional electrical pulse 7, the maximum 17 is greater than the maximum 16 of line 5 which represents the velocity without an additional electrical pulse 7.

Line 9 depicts the height of the metal cylinder 25. It reaches the zero point, e.g. the point when the metal cylinder 25 hits the surface to be cleaned 26, at the time $t_4$ 14 which is earlier than the time $t_3$ 13 where the metal cylinder 25 reaches the zero point without applying an additional electrical pulse 7.

The term "hit the surface to be cleaned 26" is not restricted to surfaces but may also mean an anvil hit by the metal cylinder 25 and connected with the surface to be cleaned 26 so that the impact causes a shock in the anvil which is transmitted to the surface to be cleaned 26. This prevents mechanical damages of the surface to be cleaned 26 caused by a repeating direct impact of the metal cylinder 25, particularly if the surface to be cleaned 26 is located on sensitive surfaces like electrodes in electrostatic precipitators.

The increased impact force and the decreased duration of a rapping cycle can also be used to increase the cleaning capacity of the electromagnetic rapper 20 since more rapping cycles can be performed in the same time than with a conventional electromagnetic rapper. Furthermore it is possible to reduce the size of the electromagnetic rapper 20 since nearly the same impact force can be obtained with a smaller lifting height of the cylinder 25. Furthermore, if the required impact force applied at the surface 26 remains the same, a reduction of the mass of the metal cylinder 25 and thus a reduction of the size of the electromagnetic rapper 20 can be conducted. Smaller electromagnetic rappers 20 have the advantage of an easier handling in application areas where space is limited.

In a preferred embodiment the additional short electrical pulse 7 for accelerating the metal cylinder 25 is adjustable and variable as well as the initial electrical pulse 4 for lifting the metal cylinder 25. The duration of the initial electrical pulse 4 influences the height to which the metal cylinder 25 is lifted and which should be measured to achieve the desired impact force to the surface to be cleaned 26. A typical trajectory is reached if the initial electrical pulse 4 is as long as it accelerates the metal cylinder 25 until it has arrived at a point approximately below the center point of the electrical coil 23. If the pulse is longer the metal cylinder 25 might hit the top of the electrical coil 23 or even might be decelerated and forced back to the center point of the electrical coil 23 without moving further to hit the surface to be cleaned 26.

The duration of the additional electrical pulse 7 defines the additional acceleration of the metal cylinder 25, and thus the additional magnetic force applied to it. With an appropriate choice of both pulse durations, a force can be applied to the surface to be cleaned which is adapted for an efficient cleaning with a reduced possibility of damaging the surface to be cleaned.

In the same way the intensity of the initial electrical pulse 4 influences the height to which the metal cylinder 25 is lifted. Likewise the intensity of the additional electrical pulse 7 defines the additional acceleration of the metal cylinder 25 and thus the additional magnetic force applied to it. With an appropriate choice of both pulse intensities or both pulse durations and intensities, a force can be applied to the surface to be cleaned 26 which is adapted for efficient cleaning with a reduced possibility of damaging the surface to be cleaned.

REFERENCE NUMERALS

1 line defining the zero height of the metal cylinder

2 time $t_1$ defining the end of the initial electrical pulse for lifting the metal cylinder

3 time $t_2$ defining the beginning of the additional electrical pulse for accelerating the metal cylinder

4 initial electrical pulse for lifting the metal cylinder

5 line depicting the metal cylinder velocity without the application of an additional electrical pulse for accelerating the metal cylinder

6 line depicting the metal cylinder height without the application of an additional electrical pulse for accelerating the metal cylinder

7 additional electrical pulse for accelerating the metal cylinder

8 line depicting the metal cylinder velocity with the application of an additional electrical pulse for accelerating the metal cylinder

9 line depicting the metal cylinder height with the application of an additional electrical pulse for accelerating the metal cylinder

10 time t0 defining the beginning of the initial electrical pulse for lifting the metal cylinder

11 greatest velocity of the metal cylinder

12 maximum point of the trajectory of the metal cylinder

13 time $t_3$ when the metal cylinder hits the surface without applying of an additional electrical pulse for accelerating the metal cylinder

14 time $t_4$ when the metal cylinder hits the surface with applying of an additional electrical pulse for accelerating the metal cylinder

15 time $t_5$ defining the end of the additional electrical pulse for accelerating the metal cylinder

16 maximum metal cylinder velocity without the application of an additional electrical pulse for accelerating the metal cylinder

17 maximum metal cylinder velocity with the application of an additional electrical pulse for accelerating the metal cylinder

20 Electromagnetic rapper

21 housing

22 metal cylinder guide

23 electrical coil

24 mounting for the rapper in a predefined distance to the surface to be cleaned or an anvil connected to the surface to be cleaned

25 metal cylinder

26 surface to be cleaned or anvil connected to the surface to be cleaned

27 wire connection for supplying the pulses

28 coil energizer

29 pulse generator

30 rapper controller

31 control signals for pulse generation

32 power source

33 wire connection for the power supply

34 data connection to the central computer

35 central computer

40 data input

41 adjuster for varying the intensity of the initial electrical pulse

42 adjuster for varying the duration of the initial electrical pulse

43 adjuster for varying the intensity of the additional electrical pulse

44 adjuster for varying the duration of the additional electrical pulse

45 calculator for calculating the duration between the initial electrical pulse and the additional electrical pulse

What is claimed is:

1. Method for the acceleration of an electromagnetic rapper, particularly for an electrostatic precipitator, which comprises a metal cylinder as a hammer, an electrical coil for lifting the metal cylinder, a coil energizer for energizing the electrical coil, wherein, to clean a surface, the metal cylinder is lifted by an initial electrical pulse generated by the coil energizer, the coil energizer supplies the electrical coil with an additional electrical pulse so that the metal cylinder is accelerated when it has reached the maximum point of its trajectory.

2. Method according to claim 1, wherein an intensity of the additional electrical pulse is varied so that the metal cylinder is accelerated to an impact force which is desired for obtaining a predefined cleaning capacity.

3. Method according to claim 1, wherein the duration of the additional electrical pulse is varied so that the metal cylinder is accelerated to an impact force which is desired for obtaining a predefined cleaning capacity.

4. Method according to claim 1, wherein the intensity of the additional electrical pulse is varied depending on the duration and the intensity of the initial electrical pulse.

5. Method according to claim 1, wherein the duration of the additional electrical pulse is varied depending on the duration and the intensity of the initial electrical pulse.

6. Method according to claim 1, wherein the duration between supplying the initial electrical pulse and the additional electrical pulse is calculated depending on the duration and the intensity of the initial electrical pulse.

7. Apparatus for the acceleration of an electromagnetic rapper, particularly for an electrostatic precipitator, comprising:

a metal cylinder as a hammer;

an electrical coil for lifting the metal cylinder; and a coil energizer for energizing the electrical coil, wherein to clean a surface, the metal cylinder is liftable by an initial electrical pulse generated by the coil energizer, said coil energizer supplies the electrical coil with an additional electrical pulse so that the metal cylinder is accelerated when it has reached a maximum point of trajectory.

8. Apparatus according to claim 7, wherein said coil energizer comprises:

a pulse generator for generating the initial electrical pulse and the additional electrical pulse; and a rapper controller for controlling the pulse generator.

9. Apparatus according to claim 8, wherein said rapper controller comprises a data input to adjust the duration and the intensity of the initial electrical pulse and the additional electrical pulse.

10. Apparatus according to claim 8 wherein said rapper controller comprises an adjuster for varying the intensity and the duration of the initial electrical pulse.

11. Apparatus according to claim 8 wherein said rapper controller comprises an adjuster for varying the intensity of the additional electrical pulse so that the metal cylinder is accelerated to an impact force which is desired for obtaining a predefined cleaning capacity.

12. Apparatus according to claim 8 wherein said rapper controller comprises an adjuster for varying the duration of the additional electrical pulse so that the metal cylinder is accelerated to an impact force which is desired for obtaining a predefined cleaning capacity.

13. Apparatus according to claim 8 wherein said rapper controller comprises an adjuster for varying the intensity of the additional electrical pulse depending on the duration and the intensity of the initial electrical pulse.

14. Apparatus according to claim 8 wherein said rapper controller comprises an adjuster for varying the duration of the additional electrical pulse depending on the duration and the intensity of the initial electrical pulse.

15. Apparatus according to claim 8 wherein said rapper controller comprises a calculator for calculating the duration between the initial electrical pulse and the additional electrical pulse.

* * * * *